United States Patent [19]

Kushner

[11] 3,934,505

[45] Jan. 27, 1976

[54] METHOD AND APPARATUS FOR SYNCHRONOUS PRINTING OF A MOVING WEB

[75] Inventor: David Kushner, New York, N.Y.

[73] Assignee: Bernard Screen Printing Corporation, New Hyde Park, N.Y.

[22] Filed: Dec. 10, 1973

[21] Appl. No.: 423,088

[52] U.S. Cl. ..... 101/129; 101/116; 101/118; 101/181; 101/248; 101/426; 226/30; 318/327; 324/161; 340/263

[51] Int. Cl.². B41F 15/10; B41M 1/12; B41F 13/24

[58] Field of Search ..... 101/115, 181, 116, 248, 101/426, 118, 126, 129; 226/27, 29, 30; 250/548, 557, 571; 340/259, 263, 268; 318/327, 640, 675; 324/161, 178, 183

[56] References Cited

UNITED STATES PATENTS

| | | | |
|---|---|---|---|
| 2,890,653 | 6/1959 | Kinzelman | 101/248 |
| 2,954,520 | 9/1960 | Barany | 324/161 |
| 3,073,997 | 1/1963 | Tagliasacchi | 101/248 |
| 3,081,700 | 3/1963 | Kieckhefer, Jr. | 101/248 |
| 3,104,997 | 3/1963 | Stewart et al. | 340/259 |
| 3,127,292 | 3/1964 | Early | 324/161 |
| 3,183,831 | 5/1965 | Zimmer | 101/116 |
| 3,304,860 | 2/1967 | Van der Winden | 101/116 |
| 3,510,036 | 5/1970 | Lewis et al. | 226/30 |
| 3,549,948 | 12/1970 | Jaeschke | 340/268 |
| 3,694,634 | 9/1972 | Horst et al. | 101/181 |

FOREIGN PATENTS OR APPLICATIONS

| | | | |
|---|---|---|---|
| 2,046,467 | 1/1972 | Germany | 101/115 |
| 1,113,438 | 2/1960 | Germany | 101/181 |

*Primary Examiner*—Edgar S. Burr
*Assistant Examiner*—R. E. Suter
*Attorney, Agent, or Firm*—Marvin Feldman

[57] ABSTRACT

A method and apparatus are disclosed wherein a signal proportional to the speed of a moving web is compared with a signal proportional to the speed of a motor driven rotary, printing member, and a resultant corrective signal is transmitted to the control for the motor, so that the linear speed of the rotary printing member is made equal to the web speed. A plurality of printing members are provided so that the linear speed of each of the printing members is made equal to the web speed and in synchronization one with the other. The method and apparatus as aforesaid are specifically adaptable for rotary screen printing of fabrics, wherein the fabric contactingly engages a plurality of rotating screens in series, and a color is passed through each screen in selected predetermined areas, so that the composite screen printings provides a repetitive design on the fabric.

7 Claims, 8 Drawing Figures

METHOD AND APPARATUS FOR SYNCHRONOUS PRINTING OF A MOVING WEB

This invention relates to synchronous printing of a plurality of printing members. Specifically this invention relates to the electronic synchronization of a plurality of rotary screens for printing a design on a moving fabric web.

In rotary screen printing of fabrics, a fabric web is moved tangentially across and in contact with a series of spaced rotary screens. Each screen is provided with a pump to pass a dye into the screen. The dye is then forced through the screen in respective predetermined areas, so that a composite multi-colored design is obtained. It is necessary for the rotary screens to be in synchronized operation so that the several colors are accurately positioned according to the particular design. This synchronization is necessary both at constant speed operation and during changes in operating speed, in order to economically produce acceptable printed fabric.

Heretofore rotary screens were mechanically interconnected by gearing so as to provide the necessary synchronized rotation of the screens. Such gearing while generally providing the necessary synchronization, was costly and often difficult to maintain. This was particularly so with several screens in series, that is, where the gear train was extensive.

A particular problem encountered in rotary screen printing is one wherein the web is adhered to an endless belt, and the belt is subject to slippage and/or stretching. This slippage and/or stretching of the belt must be compensated for to ensure proper synchronous printing. In the prior art apparati elaborate adjunct devices such as friction compensation gear boxes were necessary to compensate for these belt variances.

Now there is provided by the disclosure herein, an apparatus and method for electronic synchronization of rotary screens for fabric printing.

It is therefore an object of this invention to provide a method and apparatus for electronic synchronous printing of rotary printing members on a moving web.

It is a further object of this invention to provide a method and apparatus for improved registration for multi-color web printing.

It is a further object of this invention to provide a method and apparatus as aforesaid wherein synchronous printing is maintained at varying printing speeds, and by changing speeds.

It is another object of this invention to eliminate the need for mechanical registration adjustment gearing in rotary screen printing.

It is a further object of this invention to provide an apparatus for electronic synchronous printing with rotary screens which obviates the need for adjunct devices to compensate for belt slippage and stretching.

It is a further object of this invention to provide an apparatus and method as aforesaid wherein the web speed is electronically compared with the speed of each of a plurality of rotary printing members and a corrective electrical signal transmitted to each of the rotational control units for each respective printing member.

It is a further object of this invention to provide a method and apparatus as aforesaid wherein a first electronic signal proportional to the speed of a belt to which a web is adhered, and a second electronic signal proportional to the phase angle difference between a master syncho transmitter and a printing screen synchro transmitter, are summed and compared with a signal proportional to the printing screen speed, and a resultant corrective signal transmitted to the control means for driving the printing screen.

It is still a further object of this invention to provide an apparatus for rotary screen printing which is practical and efficient in design and operation and which is readily maintained.

Other objects of this invention will appear in the following description and appended claims, reference being made to the accompanying drawings forming a part of this specification wherein like reference characters designate corresponding parts in the several views.

Figure 1:
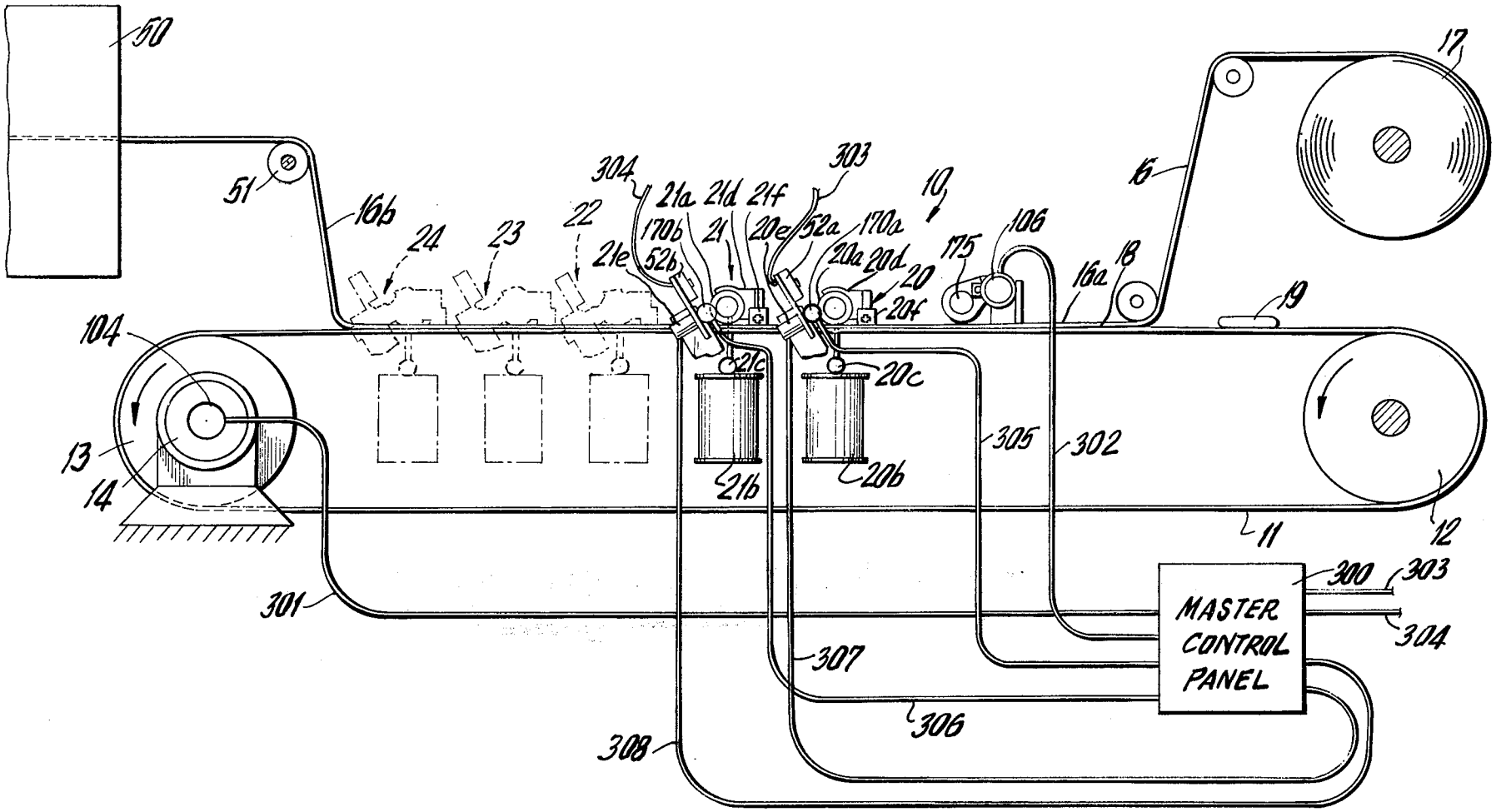
FIG. 1 is a side elevational schematic view of the apparatus of this invention.

Referring now to FIG. 1, there is shown a side elevational view of the rotary screen printing apparatus of this invention generally shown as 10. Rotary screen printing assemblies 20 and 21 of the five rotary screen printing assemblies, 20–24, are shown in full line drawing and the remaining three are depicted in representational form. All of the five rotary screen printing assemblies 20–24, are similar in design and construction. In FIG. 1 the parts of screen assemblies 22–24 corresponding to the similar parts in screen assemblies 20 and 21 are not so referenced for purposes of clarity.

An endless belt 11 is movably mounted to forward cylinder 12 and rear cylinder 13. A 20 horsepower (h.p.) d.c. motor 14 is mounted through reduced coupling to rear pulley or cylinder 13 so as to drive the belt 11 from and to cylinder 12 and from and to cylinder 13. A tachometer 104 is mounted in connection with motor 14. A web of fabric 16 is supplied from a feed roll 17 and is glued to the top surface 18 of belt 11 by means of conventional glue feed apparatus, designated as 19, at a point upstream of the printing screens. The glued web portion is shown as **16*a* and after printing, pulled away from the belt by the oven nip roll 51 as at 16*b*, downstream of the printing screens. In this manner, the glued fabric web 16*a* travels with the belt 11. After being released from the belt, the fabric web is transferred to oven 50** for drying.

Suitable glues useful pursuant to this invention include by way of example, water soluble glues, pressure sensitive glues and thermoplastic glues.

A series of five cylindrical rotary printing screen assemblies 20, 21, 22, 33, 23 and 24 are mounted above the glued web portion **16*a* and transversely disposed to belt 11**. The printing screens per se and the mountings therefore may be of conventional design and construction. The mounting of the screens is performed in the conventional manner. The screen mounting is generally shown as 20*f*–24*f*.

Each of said screen assemblies comprises a printing screen 20*a*–24*a* which is an electroformed metal screen, formed in a cylindrical shape. Each of the screens 20*a*–24*a* has fine perforations therein which define a portion of a design. The screens are each rotatably driven by means of a ½ h.p., d.c. motor 20*e*–24*e*, and interconnected by gearing therewith. Each screen assembly further comprises a screen or slave synchro 170*a*, (typical) as will be further discussed hereinafter.

A color is supplied to the interior of the cylindrical screen by means of a color supply tank 20*b*–24*b* and a color pump 20*c*–24*c*, for each of the respective printing screens. By the term "color" as used hereinbefore and hereinafter throughout the specification and claims, it is broadly defined as to mean a dye, ink, pigments or the like. Liquid colorants in the form of solutions or suspensions as well as fine particulate colorants are useful within the broad contemplation of this invention.

As each screen is rotated clockwise as in FIG. 1, and in such rotation the outer periphery 20*d*–24*d* of each respective screen 20*a*–24*a*, contactingly engages web 16*a* and a color is passed through the rotating screen onto the moving web, thereby laying down the respective design and color for each individual printing screen. That is the first printing screen 20*a* will provide one part of the design in a first color, and the second screen, a second part in a second color and so forth until a composite multi-color design is provided. It is therefore of course desirable that the screens rotate at the same speed with the speed of the fabric web in contact therewith.

To provide proper registration of the respective parts of a fabric design, each respective part being printed by one each of the rotary screens, synchronization of the belt speed, fabric web speed and printing screen speed is accomplished as will be explained hereinafter in further detail.

Figure 2:
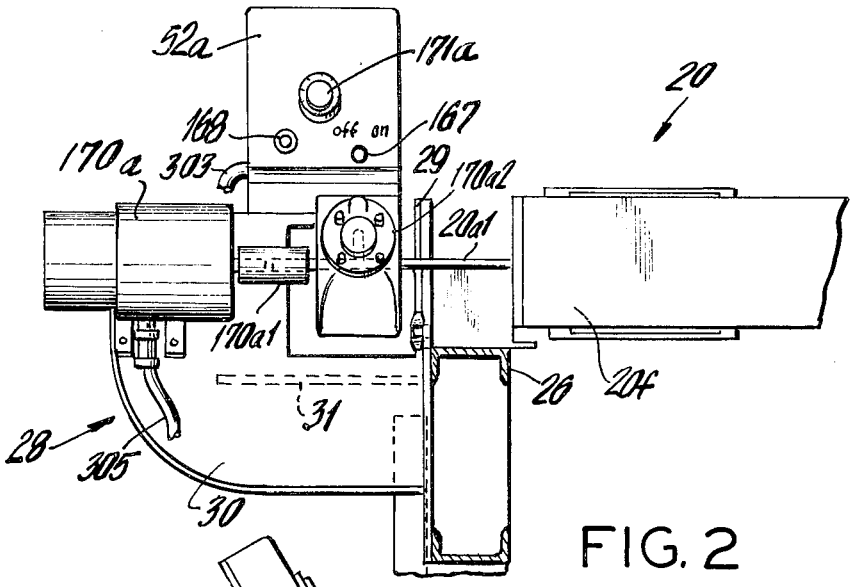
FIG. 2 is a front elevational view of the first rotary printing screen assembly.
Figure 3:
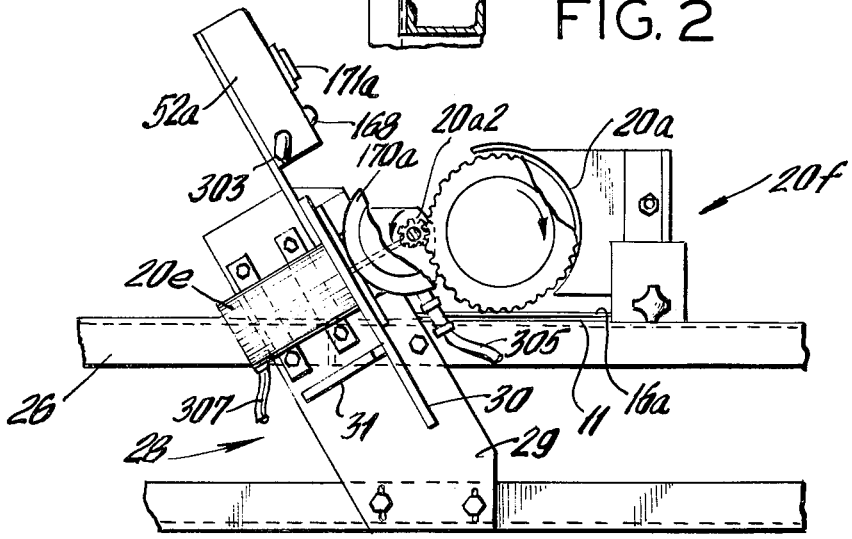
FIG. 3 is a side elevational view of the rotary printing screen assembly of FIG. 2.

In FIGS. 2–3, specific reference is made to the first rotary printing screen assembly 20 but it is of course understood that this construction is typical for screen assemblies 21–24 as well.

Each screen assembly 20–24 is mounted to a common frame 26. Frame 26 is bolt-mounted to the floor (not shown).

A motor support frame generally shown as 28 is bolt-mounted to guard member 29 which in turn is bolted to frame 26. Motor support 28 is angularly disposed to frame 26. Support frame 28 is formed of first flange 30 disposed outwardly from the screen assembly and a second flange portion 31 perpendicularly disposed to said first flange portion.

A local operating control panel 52*a* (typical of 52*a*–52*e* for each screen assembly 20–24 respectively) is shown mounted so that the operator can effectuate stopping and starting of each of the rotating screens at the screen location (panels 52*c*–52*e* are not shown). Of course a master control panel 300 is provided for operation control at one centralized location. At the local control panel 52*a*, there is an on-off switch 167 and on-off indicating lamp 168 and a positioning control 171*a* for transformer 171.

Figure 5:
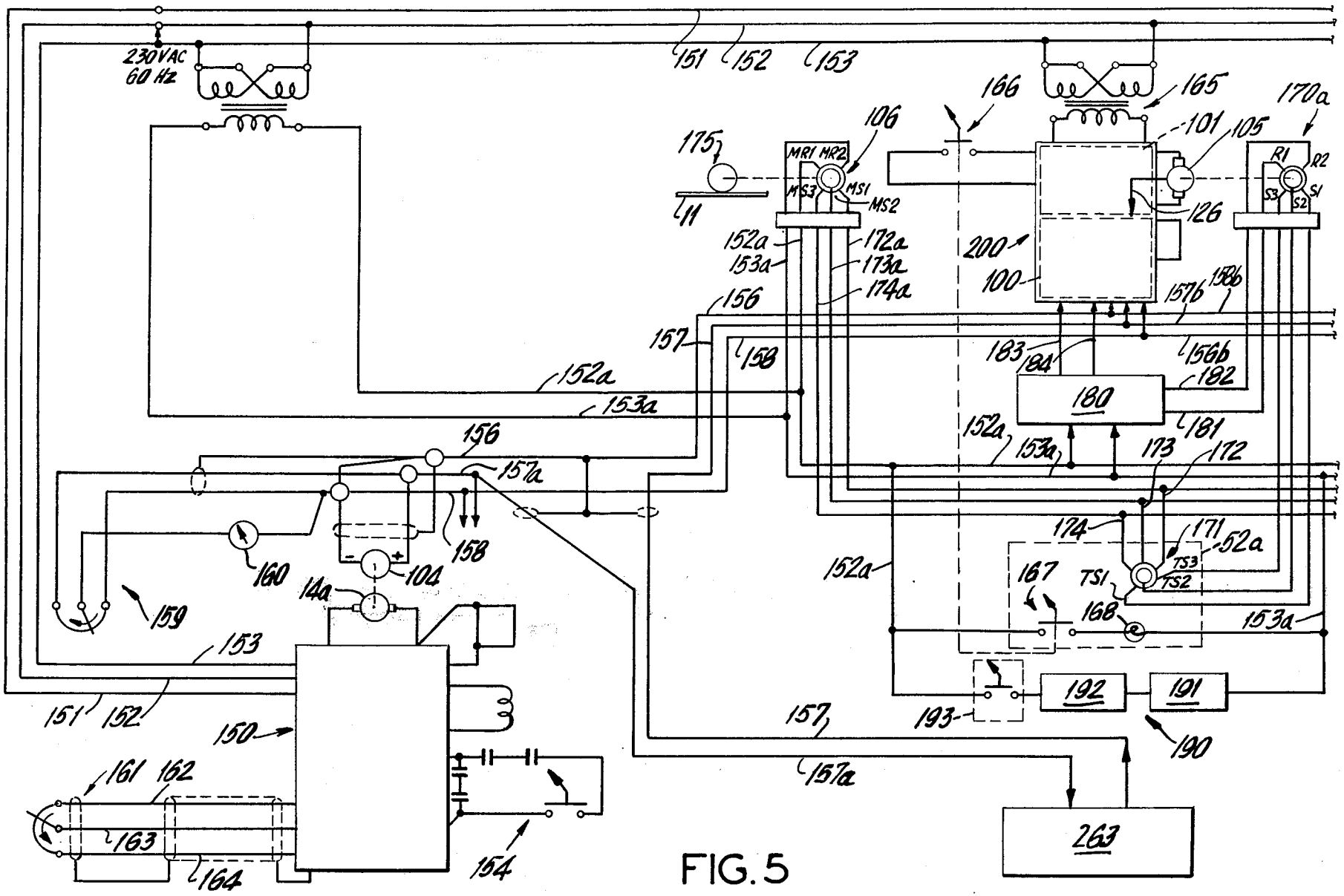
FIG. 5 is an electrical schematic of the overall electronic synchronization depicting one rotary screen.

In FIG. 1 there is shown the electrical signal lines to and from master control panel 300. Two, 20 and 21, of the five rotary screen printing assemblies 20–24 are shown interconnected to master control panel 300. A web speed signal from tachometer 104 is transmitted through line 301 to master control panel 300. Line 301 comprises electrical line connections 156, 157*a* and 158 as shown in FIG. 5. A second web speed input signal is transmitted from master synchro transmitter 106 to master control panel 300 via electrical signal line 302. Line 302 comprises lines 172*a*, 173*a* and 174*a* as shown in FIG. 5. The signal transmitted by line 302 is distributed to each local control panel 52*a*–52*e* for each respective rotary screen assembly 20–24. For example line 303 provides the master control synchro signal to panel 52*a*, or more specifically to transformer 171 of panel 52*a* (FIG. 5). Likewise line 304 provides the master control signal to panel 52*b* of rotary screen printing assembly 21. By way of example line 303 comprises electrical lines 172, 173 and 174 (FIG. 5).

It is of course understood that the signal line interconnection of any one screen assembly is typical for each screen assembly 20–24.

Each screen or slave synchro, 170*a*–170*e* for each respective rotary screen assembly 20–24, provides a signal to the master control panel, which signal is eventually summed with the signal from the d.c. tachometer 104 and the armature feedback signal for the respective d.c. motor 20*e*–24*e*. For example electrical signal line 305 connects the first screen synchro 170*a* to master control panel 300 and electrical signal line 306 likewise connects the second screen synchro 170*b* to master control panel 300, and so forth. Electrical signal line 305 comprises electrical signal lines 181 and 182 (FIG. 5).

Further each screen synchro, d.c. motor 20*e*–24*e* respectively, is interconnected to master control panel 300, through an electrical line, as by way of example line 307 for motor 20*e* and line 308 for motor 21*e*. Line 307 comprises armature feedback signal 126 (FIG. 6) as well as corrective signal input to the armature of the respective d.c. motor (e.g. FIG. 6).

Figure 4:
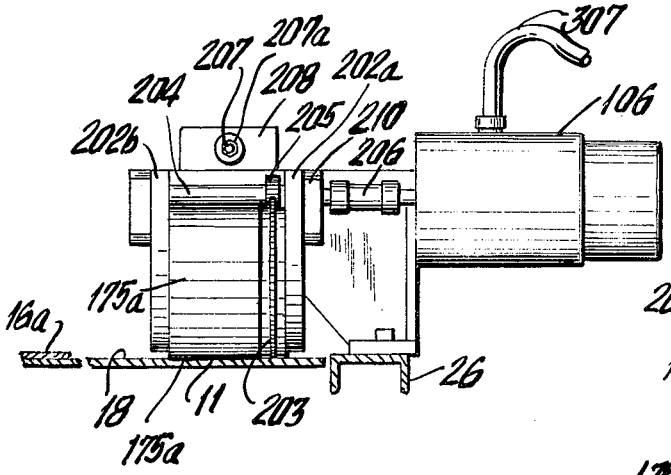
FIG. 4 is a rear view of the master synchronization assembly.

Referring now to FIGS. 1 and 4, there is shown, the master synchronization roller assembly comprising, a hollow rotatable roller 175, rotatably mounted to and transversely disposed between a pair of opposed mounting brackets 202*a* and 202*b*. A cylindrical gear 203 is mounted to roller 175 so that as to be rotatable therewith. A rotatable shaft 204 is rotatably housed and transversely disposed to brackets 202*a* and 202*b*. Gear 205 is fixedly supported on shaft 204 so as to be rotatable therewith. Further the teeth of ear 205 mesh with the teeth of cylindrical gear 203 so as to permit translation of rotation from roller 175 to shaft 204. Shaft 204 is in turn coupled by coupling 206 to the input side of master synchro transmitter 106. A suitable master synchro transmitter pursuant to this invention WER Model 777-20 of the WER Industrial Corporation, Grand Island, New York.

Figure 8:
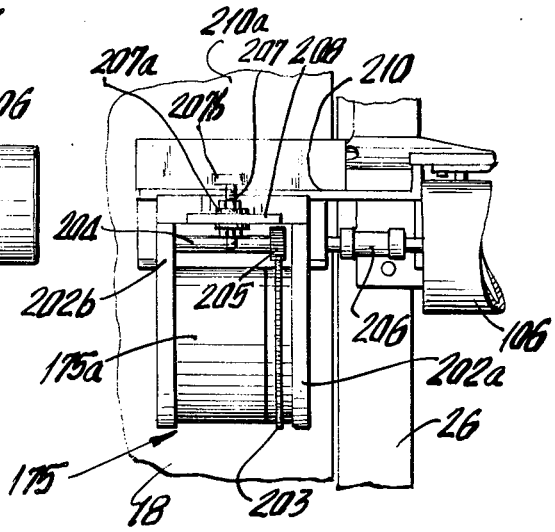
FIG. 8 is a plan view of the master roller synchronization assembly of FIG. 4.

The cylindrical periphery 175*a* of roller 175 contactingly engages the top 18 of endless belt 11. A belt contact adjustment bolt 207 is provided. One end of bolt 207 is mounted by means of nuts and washers shown as 207*a*, to plate 208 which plate is in turn mounted to each of the brackets 202*a* and 202*b*. The opposing head end of bolt 207 is fixedly mounted to plate 210*a* of support frame 210 as shown as 207*b* as seen in FIG. 8. Frame 210 is inturn fixedly bolt-mounted to frame 26. By adjusting the nuts 207*a*, the bolt 207 distance between plate 208 and plate 210*a* of frame 210 is varied and brackets 202*a* and 202*b* and roller 175 are caused to rotate about shaft 204. In this manner of construction the roller-to-belt contact may be adjusted to the desired suitable degree.

As belt 11 moves, roller 175 and cylindrical gear 203 are caused to rotate. This rotational motion is in turn translated to gear 205 and concommitantly to shaft 204 and through coupling 206 to master synchro transmitter 106. Master synchro transmitter 106 translates this rotational movement to a phase angle related electrical signal which is eventually transmitted to each screen or slave synchro.

It has been found advantageous to pressingly engage surface 175*a* of roller 175 into top 18 of endless belt 11, thereby locally deforming the rubber endless belt 11.

Each screen or slave synchro 170*a*–170*e* is coupled by a helical spring type coupling 170*a*1 (typical) to an angularly disposed, minimum back-lash gear box 170*a*2 (typical). The gear box 170*a*2 is in turn connected to the shaft of d.c. motor 20*e*. On the output end of gear box 170*a*2 is a drive shaft 20*a*1 which in turn is axially mounted to the drive gear 20*a*2 of screen 20*a*.

As stated each screen 20*a*–24*a* is mounted above the belt by means of mounting 20*f*–24*f*. A suitable mounting is the Stork Brabant (VMF Corp.) RD3HD 1850 mm cross arm.

Control panel 52*a* is shown mounted in FIGS. 2 and 3 as being mounted to flange 30 adjacent one end of screen 20*a*. It is to be noted however that insofar as the synchronization control is electrical as opposed to mechanical the control panel 52*a* may be located at any desired location for ease of operation, unlike prior art mechanical synchronization apparatus. As such this degree of selection of location of control panels constitutes a further object and advantage of the apparatus of this invention.

As used hereinbefore and hereinafter throughout the specification and claims by the terms, "signal proportional to the speed of the moving web", it is to mean a signal emanating from the movement of the belt to which the web is adhered; as by way of the examples herein, to wit, the belt speed d.c. tachometer signal inasmuch as the moving web is adhered to the belt, or the roller speed master synchro signal inasmuch as the moving belt contactingly tangentially engages the roller and causes rotation thereof.

Referring now to FIG. 5, there is shown the motor control for the belt drive generally shown as 150. A suitable belt drive motor control is the Electrostat 225, 20 h.p., 230 VAC, D.C. motor control No. 1060-112 of the WER Industrial Corporation, Grand Island, New York ("Electrostat", is a registered trademark of WER Industrial Corporation, Grand Island, New York).

Belt drive motor contol 150 comprises line source power input lines 151, 152, 153 from a power source not shown. An on-off switch 154 is mounted with the belt drive D.C. motor 14. The armature 14*a* of d.c. motor 14 is interconnected to a 50 volt/1000 rpm d.c. tachometer 104. The tachometer 104 thereby transmits a signal proportional to the belt speed through lines 156, 157*a* and 158. Meter calibration control switch 159 and meter 160 for tachometer 104 are interconnected to lines 156, 157*a* and 158. Also a second belt line speed switch 161 is interconnected to motor control 150 through lines 162, 163 and 164. Switch 161 is mounted in tandem to a similar switch for the oven nip roll motor control circuit (not shown) so that the belt line speed will be proportional to the oven nip roll speed so as to assure a smooth travel of the web from the belt to the oven 50.

Output line 156a is connected to an inverter 262 to effect a -1/10 signal inversion which is transmitted through line 157 with the corresponding part of the signal 156 and 158, to one rotary screeen drive motor control circuit, generally shown as 200 (typical for each screen assembly) as will be further discussed more fully hereinafter. It is of course understood that belt speed signal lines 156, 157 and 158 provides the same signals to the motor control circuit for all the rotary screens as indicated by lines 156*b*, 157*b* and 158*b* to the next screen drive, and so on.

The motor control circuit 200 comprises interconnected motor control, circuits 100 and 101, which sub-circuits are in turn connected to power source through transformer 165, by power lines 152 and 153. A first on-off type switch 166 is mounted directly to the control circuits 100 and 101 and a seond on-off type switch 167 is located at the rotary screen local control panel 52*a*. A light indicator 168 indicates when the power is on to the motor control circuits 100 and 101. Switch 167 and indicator 168 are interconnected to d.c. power lines 152*a* and 153*a*. The armature 105 of the d.c. motor for the rotary screen is interconnected to circuit 101 of the motor control circuit. The armature is in turn connected to a synchro transmitter 170*a*. Synchro transmitter 170*a* comprises rotors R1 and R2 and stators S1, S2 and S3. Stators S1, S2 and S3 are line connected to corresponding stators TS1, TS2 and TS3 of differential transformer mounted 171 at local control panel 52. The input side of differential transformer 171 is interconnected through lines 172, 173 and 174 to the stators MS1, MS2 and MS3 of master synchro 106. By this manner of interconnection the output signal from master synchro 106 is isolated to each individual synchro transmitter for each rotary screen assembly. This permits the same undisturbed master synchro signal to be transmitted to the synchro transmitter for each rotary screen assembly.

Master synchro 106 is interconnected to belt speed pick-up roller 175. The circumference 175*a* of roller 175 of course tangentially contacts the belt top 18. The master synchro rotors MR1 and MR2 are connected to d.c. line source through lines 152*a* and 153*a*.

In this manner of construction roller 175 drives master synchro 106 through stators MS1, MS2 and MS3 which transmits a signal through main lines 172*a*, 173*a* and 174*a* to lines 172, and 174 to differential transformer 171 where the signal is transmitted to stators S1, S2 and S3 of screen synchro 170 and then voltage signal proportional to the phase angle of the armature 105 is transmitted through rotors R1 and R2 and lines 181 and 182 to discriminator 180. A d.c. line source is supplied to discriminator 180 through lines 152*a* and 153*a*. An output voltage signal proportional to the phase angle difference between the rotors of the synchro transmitter 170 and the rotors of master synchro transmitter 106, that is an angular position signal is transmitted as an input signal through lines 183 and 184 to the summation or comparison circuit 102 of motor control circuit 100 (See FIG. 6). A suitable synchro 170 is WER No. 777-1.

The belt speed input signal through lines 156*b*, 157*b* and 158*b*, is also transmitted from tachometer 104 to the summation or comparison circuit 102 of motor control circuit 100.

To complete the summation input, armature reference signal 126 is transmitted to the summation circuit of motor control circuit 100 for comparison with the belt speed signal and the aforesaid rotary screen signal.

A color supply circuit 190 is interconnected to feed lines 152*a* and 153*a*, and which color supply circuit comprises a color pump starter 191, a color supply level control 192, and a color pump switch 193.

Figure 6:
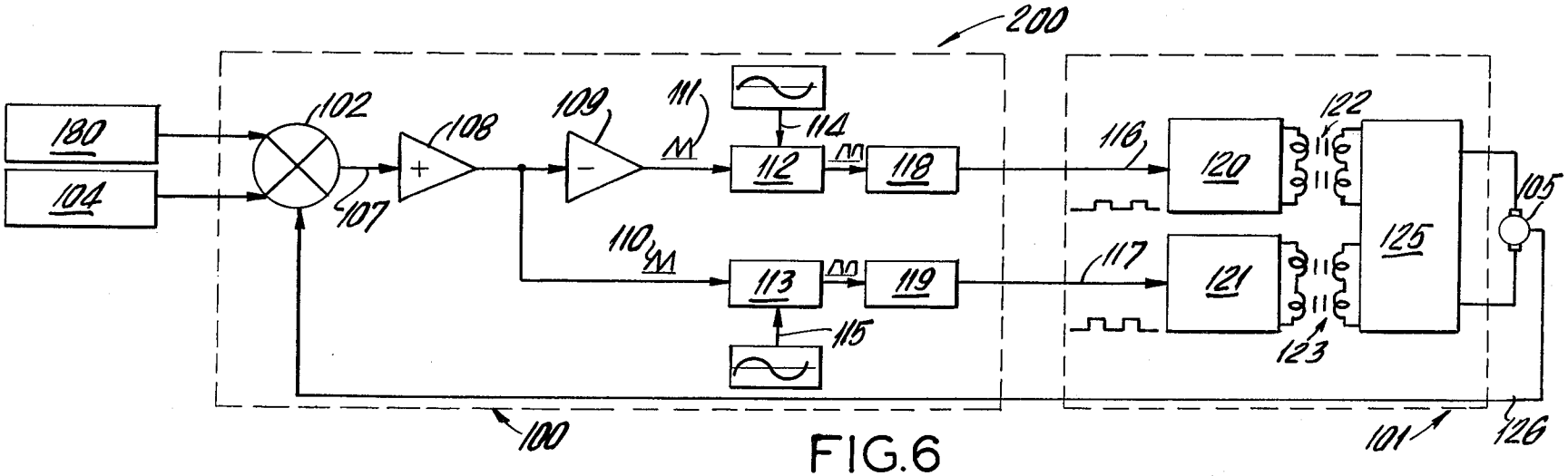
FIG. 6 is a schematic illustration of the electronic synchronization process for one rotary printing screen.

Referring now to FIG. 6, there is schematically shown the electronic synchronization for typically any one rotary printing screen operation 200, which comprises two sub-circuit assemblies 100 and 101; said circuits 100 and 101 being electrically interconnected.

A suitable commercially available circuit board assembly for circuit assembly 100 is P.C. Board 1082-1B2, and for circuit assembly 101 it is P.C. Board 1082-1B1, of the 100 ARG, 115 VAC, Regenerative d.c. Motor Control, manufactured by WER Industrial Corporation, Grand Island (Buffalo) New York.

Assembly 100 is shown as having a summation circuit 102 which sums the signal from discriminator 180, the signal from belt drive d.c. tachometer 104 and the signal 126 from the armature 105 of the d.c. motor, for typically each of the rotary screens 20–24.

The signals from the discriminator 180, belt drive d.c. tachometer 104, and armature 105 are proportionally scaled so that if the linear screen speed is proportionally equal to the belt speed, and the rotor phase angle of the armature 105 is in agreement with rotor phase angle of the master synchro 106, then the summation output signal 107 will approach zero. If however the web speed (i.e. d.c. tachometer signal) is greater or lesser than the screen speed (i.e. armature signal), or the screen synchro is not in agreement with the master synchro, so as to instantaneously initiate a corrective signal to the armature 105 of the screen motor for motoring (advance the screen, in one rotational direction) or braking (retard the screen, in the other rotational direction) the rotating printing screen.

Summation output signal 107 is fed to the input side of the first operational amplifier 108 in series with a second operational amplifier 109, which second operational amplifier is in sign inversion with the first operational amplifier, so that a positive d.c. ramp signal 110 will be emitted from first operational amplifier 108 or alternatively a positive d.c. ramp signal 111 will be emitted from second operational amplifier 109. By convention d.c. ramp signal 111 will be considered the motoring signal and d.c. ramp signal 110 will be considered the braking signal.

D.C. signal 111 is transmitted to motoring pulse positioning circuit 112 and d.c. signal 110 is transmitted to braking pulse positioning circuit 113. A rectified line source d.c. reference signal 114 is transmitted to motoring pulse positioning circuit 112, and a rectified line source d.c. reference signal 115 is transmitted to braking pulse positioning circuit 113.

In the aforesaid pulse positioning circuits, for any given half-wave cycle, the d.c. ramp signal from one respective amplifier is summed with the line source d.c. reference signal and a resultant time displaced signal is transmitted to a threshold switch 118 (for motoring) or alternatively but not coincidentally a resultant time displaced signal is transmitted to threshold switch 119 (for braking). The threshold switch 118 or 119, is set to cut off the signal from the pulse positioning circuit 112 or 113, respectively, as to provide a trigger corrective signal 116 (motoring) or alternatively but not coincidentally 117 (braking) to the driver circuits 120 (motoring) and 121 (braking) of circuit assembly 101. It is of course understood that corrective signals 116 and 117 as depicted in FIG. 6 are merely illustrious and the magnitude and time displacement, that is the point in a half-cycle where the pulse is initiated, will vary with the input signals to summation circuit 102.

Driver circuit 120 is connected by transformer circuit 122 to thyristors such as silicon rectifier SCR's 1, 4, and 2, 3 of silicon rectifier bride 125, and driver circuit 121 is connected by transformer circuit 123 to thyristors such as silicon rectifiers SCR's 6, 7 and 5, 8 of said silicon rectifier bridge 125.

The armature 105 is interconnected with the silicon rectifier bridge 125 and an armature feedback signal 126 is transmitted to summation circuit 102 to close the loop so as to provide a servo type control for the rotary printing screen operation.

Figure 7:
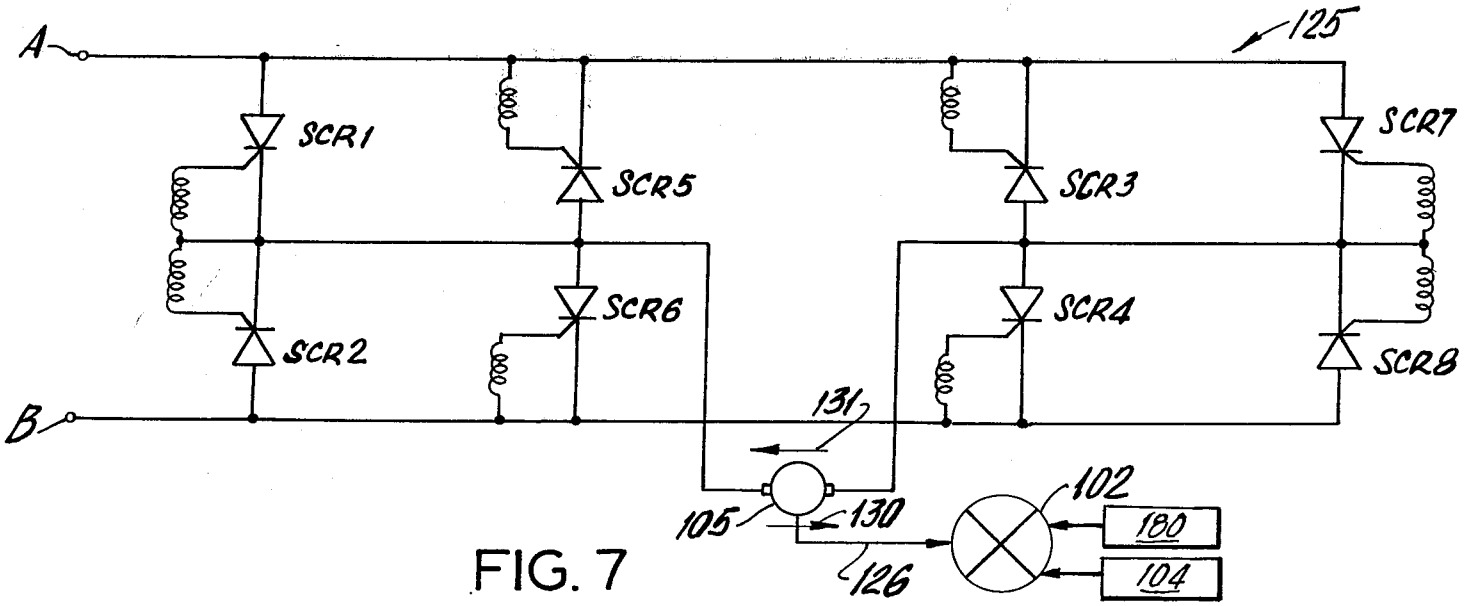
FIG. 7 is a schematic of the rectifier bridge circuit for the motor control for one rotary printing screen.

Referring now to FIG. 7 there is shown the silicon rectifier bridge circuit 125, comprising 2 sets of four thyristors such as gated silicon rectifiers SCR 1–8, the first SCR set being SCR's 1, 4 and SCR's 2, 3 for motoring, and the second SCR set being SCR's 6, 7 and SCR's 5, 8 for braking. SCR's 1 and 4 are gated to permit current to flow in one direction in one half-cycle when line source reference point A is positive with respect to line source reference point B. Counterpart motoring SCR's 2 and 3 will permit current flow in the same direction during the next immediate half-cycle when line source reference point B is positive with respect to A. Similarly SCR's 6, 7 and SCR's 5, 8 will provide current to the armature 105 in the other direction for full wave rectification in braking as opposed to motoring.

The gates of SCR's 1 4 and 2, 3 are connected through transformer circuit 122 to drive circuit 120. And the gates of SCR's 6, 7 and 5, 8 are interconnected through transformer circuit 123 to drive circuit 121.

The corrected current to the armature may therefore either be in motoring 130 direction or in braking 131 direction. The armature in turn provides a reference signal 126 to the summation circuit 102 so as to close the motor control loop as hereinbefore described.

In other words the master synchro provides a first signal proportional to the speed of the moving web and this signal is transmitted through each screen synchro or slave synchro to provide voltage signal proportional to the phase angle differential (angular error) between the master synchro and screen synchro, which is transmitted to the summation or comparison circuit of the motor control circuits. And the belt drive d.c. tachometer provides a second signal proportional to the belt speed, and therefore the web speed inasmuch as the web is glued to the belt, also to the summation or comparison circuit of the motor control circuits. The aforesaid first and second signals are summed in comparison to the armature reference signal proportional to the actual position of the rotary screen. In comparing the web speed signals with each rotary screen signal, a resultant corrective signal is then transmitted to each respective armature to bring each screen speed into accord with the web speed and therefore all the screens into synchronization.

The second web speed signal being derived from the belt drive provides a gross signal for comparison with each screen signal in contradistinction to the first web speed signal derived from the master roller in direct contact with the belt, and as such accounts for local mechanical variances, such as belt slippage or stretching, and electrical perturbations which would otherwise put the screens out of synchronization.

It has been found that this combination of signal inputs to the motor control circuit provides a method and apparatus for quick response to both the gross changes in line speed as well as to localized changes in the printing operations, so that synchronization is effected and maintained under varying conditions.

Of course the armature of the motor continuously provides feedback to the motor control circuit and is continuously matched against the belt speed signal and the web speed signals to provide a servo type control.

It will be clear that there is provided a method and apparatus which accomplishes the objective heretofore set forth.

While the invention has been disclosed in its preferred forms, it is to be understood that the specific embodiments thereof, as described and illustrated herein, are not to be considered in a limiting sense, as there may be other forms or modifications of the invention which should also be construed to come within the scope of the appended claims.

What is claimed is:

1. A method for synchronous printing on a moving fabric web comprising:

a. moving a fabric web on an endless belt across a first rotating cylindrical printing screen and then across a second rotating cylindrical printing screen;

b. transmitting a first electrical signal proportional to the speed of said web from said belt to a first signal comparator;

c. transmitting a second electrical signal proportional to the speed of said web from means moving said belt to said first signal comparator;

d. transmitting an electrical signal proportional to said first printing screen speed to said first signal comparator;

e. transmitting a corrective signal from said first signal comparator to control means for rotating said first printing screen;

f. transmitting said first electrical signal proportional to the speed of said web to a second signal comparator;

g. transmitting said second electrical signal proportional to the speed of said web to said second signal comparator;

h. transmitting an electrical signal proportional to said second printing screen speed to said second signal comparator;

i. transmitting a corrective signal from said second signal comparator to control means for rotating said second printing screen; so that the speed of each of said printing screens is made equal to the web speed and in synchronization with the other.

2. The method of claim 1, wherein the step of transmitting a second electrical signal proportional to the web speed comprising tangentially contacting the endless belt with a rotatable cylinder so as to rotate the cylinder, and converting the mechanical rotation to an electrical signal proportional to the web speed.

3. The method of claim 1, further comprising the last step of releasing the printed web from said endless belt after printing said web.

4. An apparatus for synchronous screen printing on a moving fabric web comprising in combination: endless belt means to move said fabric web comprising means to support said moving web so that said web is tangentially disposed to the printing screens and means to bond said web to said means to support said web, means to drive said endless belt means, means to transmit an electrical signal proportional to the speed of said moving web, a first printing screen and a second printing screen transversely disposed to said web and spaced one from the other along said web, means to rotate the first printing screen and means to rotate said second printing screen, means to transmit an electrical signal proportional to the speed of said first printing screen and means to transmit an electrical signal proportional to the speed of said second printing screen, means to compare said first printing screen speed signal with said web speed signal and transmit a resultant signal to said means to rotate said first printing screen, and means to compare said second printing screen speed signal with said web speed signal and transmit a resultant signal to said means to rotate said second printing screen, wherein said means to transmit an electrical signal proportional to the speed of the moving web comprises means to transmit a first signal comprising a rotatable cylinder, the rotational surface of said cylinder pressingly engaging said endless belt and being rotated with the movement of said endless belt and further comprising master synchro transmitter means to transmit said electrical signal proportional to the speed of the moving web, and means to interconnect said master synchro transmitter means to said cylinder, and slave synchro transmitter means for each of said printing screens operably connected to said means to compare said signals and means to electrically interconnect said master synchro transmitter means with each of said slave synchro transmitter means, and means to transmit a second signal proportional to the speed of the web from said means to drive said endless belt means, whereby the speed of each of said printing screens is made equal to said web speed so that said printing screens are in synchronization.

5. The apparatus of claim 4, wherein said means to transmit the web signal is spaced from said first screen in the upstream direction of the moving web.

6. The apparatus of claim 4, wherein said means to transmit said second signal comprises a tachometer, said tachometer being interconnected to the armature of said endless belt motor.

7. The apparatus of claim 4, wherein said cylinder is spaced from one edge of said web and wherein said cylinder is spaced from said first screen in the upstream direction of the moving web.

* * * * *